US006294994B1

(12) United States Patent
Hoellerich

(10) Patent No.: US 6,294,994 B1
(45) Date of Patent: Sep. 25, 2001

(54) APPLIANCE ATTENDANCE MONITORING APPARATUS

(76) Inventor: Wendy Hoellerich, 45 Henry Wood Rd., Adams, MA (US) 01220

( * ) Notice: Subject to any disclaimer, the term of this patent is extended or adjusted under 35 U.S.C. 154(b) by 0 days.

(21) Appl. No.: 09/520,651

(22) Filed: Mar. 7, 2000

Related U.S. Application Data

(60) Provisional application No. 60/124,336, filed on Mar. 15, 1999.

(51) Int. Cl.[7] ..... G08B 21/00

(52) U.S. Cl. ..... 340/540; 340/500; 340/655; 219/490

(58) Field of Search ..... 340/540, 655, 340/568.1, 588, 500; 361/179, 189, 190; 219/446.1, 448.12, 490, 445.1, 506; 307/141, 140

(56) References Cited

U.S. PATENT DOCUMENTS

| | | | | |
|---|---|---|---|---|
| 3,767,937 | * | 10/1973 | Schmidgall | 307/133 |
| 4,070,670 | | 1/1978 | Chen . | |
| 4,659,909 | | 4/1987 | Knutson . | |
| 4,775,913 | | 10/1988 | Ekblad . | |
| 5,380,985 | | 1/1995 | Graham . | |
| 5,608,383 | * | 3/1997 | Neil | 340/584 |
| 5,717,188 | * | 2/1998 | Vaillancourt | 219/452 |
| 5,854,520 | * | 12/1998 | Buck | 340/500 |
| 5,945,017 | * | 8/1999 | Cheng | 219/446.1 |
| 5,949,333 | * | 9/1999 | Lehmann | 340/571 |

* cited by examiner

*Primary Examiner*—Jeffery Hofsass
*Assistant Examiner*—Anh La

(57) ABSTRACT

An attendance monitoring apparatus is provided for an appliance, such as an electrical appliance, and includes a housing and a motion sensor assembly contained in the housing. A timer assembly is electrically connected to the motion sensor assembly, and an alarm assembly is electrically connected to the timer assembly. The timer assembly is adjustable for selecting a range of predetermined time intervals. Optionally, a current controller is electrically connected to the timer assembly. The current controller controls electric power to the appliance, such as an electric stove. The attendance monitoring apparatus of the invention signals a person with an audible alarm when the person has not attended to the electric stove for a predetermined period of time. Optionally, the attendance monitoring apparatus can turn off electrical power to the stove under these conditions. In this way, the attendance monitoring apparatus of the invention increases an operator's freedom and electric stove safety when the stove is in use. As a result, the attendance monitoring apparatus can prevent fires and save lives.

1 Claim, 2 Drawing Sheets

FIG 3
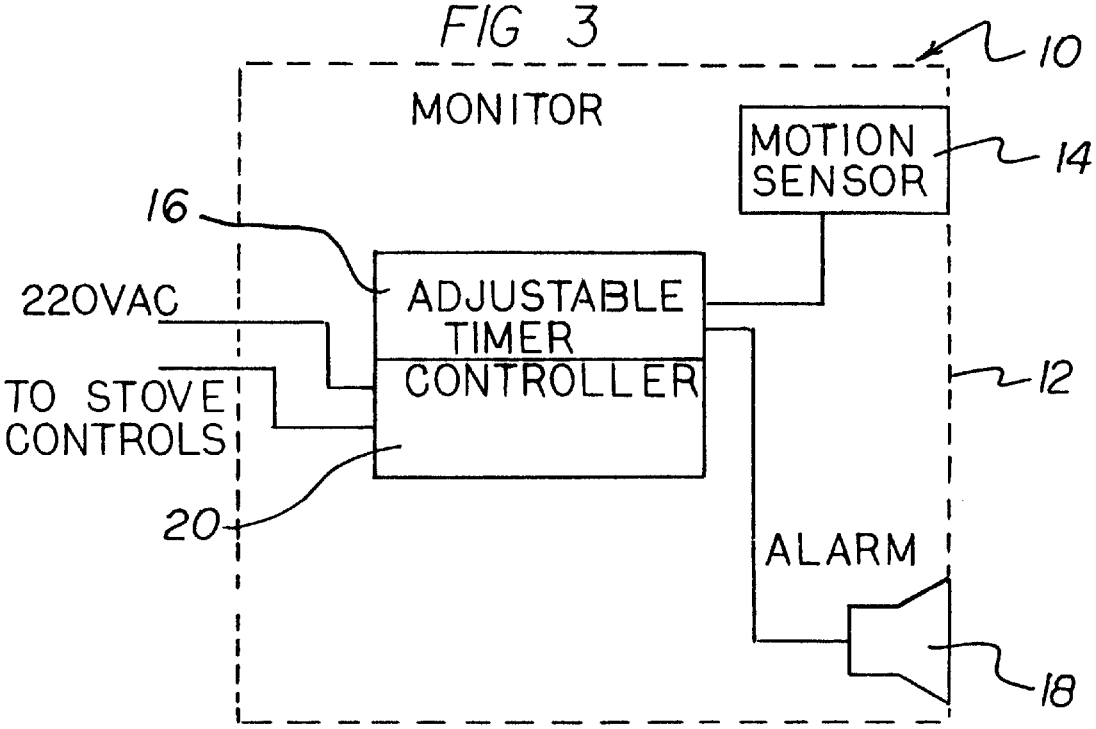
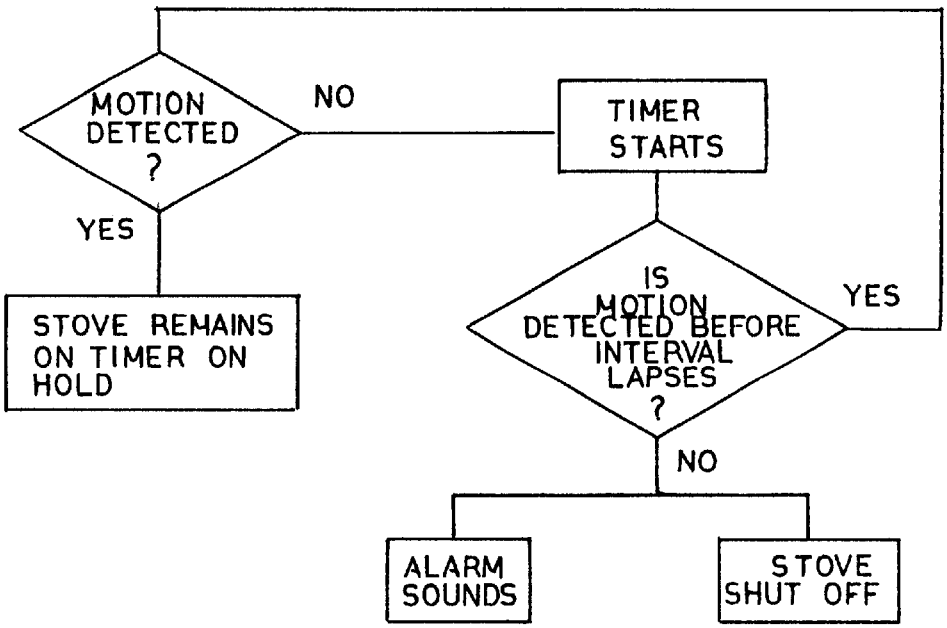
FIG 4

APPLIANCE ATTENDANCE MONITORING APPARATUS

CROSS-REFERENCE TO RELATED APPLICATION

This application claims priority based upon my copending Provisional Application Ser. No. 60/124,336, filed Mar. 15, 1999.

BACKGROUND OF THE INVENTION

1. Field of the Invention

The present invention relates generally to appliances that may be hazardous if left unattended, and relates particularly to reducing hazards of appliances left unattended.

2. Description of the Prior Art

Appliances such as stoves may be hazardous if left unattended. Items which are on the stove may boil over or overheat when left unattended, leading to the production of smoke and fire. Throughout the years, a number of innovations have been developed relating to the reduction of hazards from unattended stoves, and the following U.S. patents are representative of some of those innovations: U.S. Pat. Nos. 4,070,670, 4,659,909, 4,775,913, 5,380,985, and 5,717,188. More specifically, U.S. Pat. No. 4,070,670 discloses a device that senses the occurrence of the hazardous conditions of water spillage or overflow in a cooking burner unit, sounds an alarm when a hazardous condition has occurred, and shuts off fuel flow to the burner. Although is it desirable to sense the occurrence of a hazardous condition, and it is desirable to sound an alarm when the hazardous condition has occurred, it would also be desirable to prevent a hazardous condition in the first place. In this respect, it would be desirable if an apparatus would alert a person that an appliance has been unattended for a predetermined period of time. Then, once alerted, the person could attend to the appliance and prevent the occurrence of a hazardous condition.

U.S. Pat. No. 4,659,909 discloses a device that shuts off electric power to a kitchen range when the hazardous condition of smoke has been detected. Here is another example of a device that responds to a hazardous condition rather than alerting a person prior to the occurrence of the hazardous condition. Another feature of this and the previously discussed patent relates shutting off power to the appliance one the hazardous condition has been detected. To cut off power to the appliance, the wiring or fuel source for the appliance is modified. Such modifications can be time consuming and costly. In order to avoid time consuming and costly modifications to the wiring or fuel source of an appliance, it would be desirable if a device were provided which simply signals a person to be attentive to an appliance without the need for modifying the wiring or fuel source of the appliance.

U.S. Pat. Nos. 4,775,913, 5,380,985, and 5,717,188 have a number of features in common. They all relate to an electric stove. They all sense the presence of a person near the electric stove. They all have a timer which begins to run when the person is not sensed in the presence of the electric stove. They all turn off electric power when the person has not been sensed near the electric stove for a predetermine period of time. In addition, they all do not employ an alarm to alert a person that the predetermined period time has expired. Rather than turning off an electric stove when a person has not been sensed for a predetermined period of time, it would be desirable if a person would be signalled audibly when the predetermined period of time has expired.

Still other features would be desirable in an appliance attendance monitoring apparatus. For example, in some instances, it would be desirable if both a person would be given an audible signal and electric power would be shut off to the appliance after a predetermined period of time has elapsed.

A large number of electric ranges are presently in use which do not provide alarms to signal a person that the electric range has not been attended to for a predetermined period of time. In this respect, it would be desirable if an appliance attendance monitoring apparatus were provided that can be easily retrofitted to such electric ranges.

Thus, while the foregoing body of prior art indicates it to be well known to use monitors for turning power off to an appliance after a predetermined period of time has expired without sensing the presence of a person, the prior art described above does not teach or suggest an appliance attendance monitoring apparatus which has the following combination of desirable features: (1) employs an audible signal to alert a person that an appliance has been unattended to prevent the occurrence of a hazardous condition; (2) signals a person to be attentive to an appliance without modifying the wiring or fuel source of the appliance; (3) signals a person audibly when a predetermined period of time has expired with an appliance not being attended to by a person; (4) both provides an audible signal to a person and shuts off electric power to the appliance after a predetermined period of time has elapsed without a person being in attendance of the appliance; and (5) can be easily retrofitted to electric ranges that do not currently provide alarms to signal a person that the electric range has not been attended to for a predetermined period of time. The foregoing desired characteristics are provided by the unique appliance attendance monitoring apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an attendance monitoring apparatus for an appliance, such as an electrical appliance, and includes a housing and a motion sensor assembly contained in the housing. A timer assembly is electrically connected to the motion sensor assembly, and an alarm assembly is electrically connected to the timer assembly. The timer assembly is adjustable for selecting a range of predetermined time intervals. Optionally, a current controller is electrically connected to the timer assembly. The current controller controls electric power to the appliance, such as an electric stove. The attendance monitoring apparatus of the invention signals a person with an audible alarm when the person has not attended to the electric stove for a predetermined period of time. Optionally, the attendance monitoring apparatus can turn off electrical power to the stove under these conditions. In this way, the attendance monitoring apparatus of the invention increases an operator's freedom and electric stove safety when the stove is in use. As a result, the attendance monitoring apparatus can prevent fires and save lives.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved appliance attendance monitoring apparatus which has all of the advantages of the prior art and none of the disadvantages.

It is another object of the present invention to provide a new and improved appliance attendance monitoring apparatus which may be easily and efficiently manufactured and marketed.

It is a further object of the present invention to provide a new and improved appliance attendance monitoring apparatus which is of durable and reliable construction.

An even further object of the present invention is to provide a new and improved appliance attendance monitoring apparatus which is susceptible of a low cost of manufacture with regard to both materials and labor, and which accordingly is then susceptible of low prices of sale to the consuming public, thereby making such appliance attendance monitoring apparatus available to the buying public.

Still yet a further object of the present invention is to provide a new and improved appliance attendance monitoring apparatus which employs an audible signal to alert a person that an appliance has been unattended to prevent the occurrence of a hazardous condition.

Still another object of the present invention is to provide a new and improved appliance attendance monitoring apparatus that signals a person to be attentive to an appliance without modifying the wiring or fuel source of the appliance.

Yet another object of the present invention is to provide a new and improved appliance attendance monitoring apparatus which signals a person audibly when a predetermined period of time has expired with an appliance not being attended to by a person.

Even another object of the present invention is to provide a new and improved appliance attendance monitoring apparatus that both provides an audible signal to a person and shuts off electric power to the appliance after a predetermined period of time has elapsed without a person being in attendance of the appliance.

Still another object of the present invention is to provide a new and improved appliance attendance monitoring apparatus that can be easily retrofitted to electric ranges that do not currently provide alarms to signal a person that the electric range has not been attended to for a predetermined period of time.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a block electrical circuit diagram of an embodiment of the invention in which the appliance attendance monitoring apparatus turns off an electric range when the electric range is unattended for a predetermined period of time.

FIG. 4 is a logical flowchart illustrating operation of the embodiment of the invention whose circuit diagram is illustrated in FIG. 3.

DESCRIPTION OF THE PREFERRED EMBODIMENT

With reference to the drawings, a new and improved appliance attendance monitoring apparatus embodying the principles and concepts of the present invention will be described.

Figure 1:
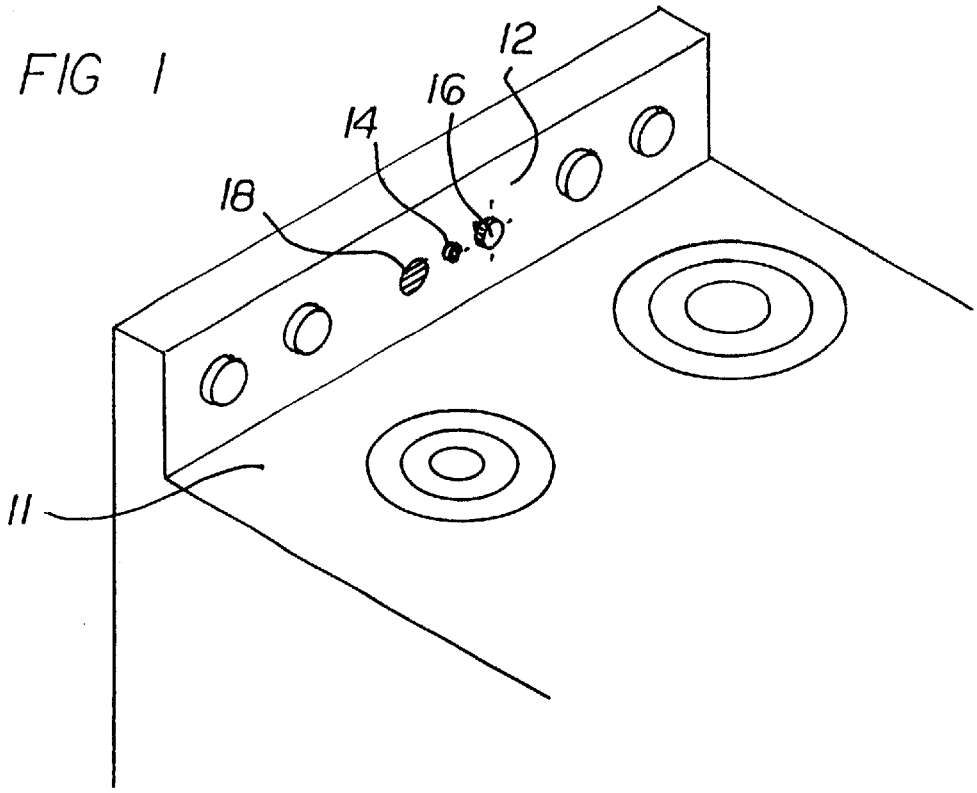
FIG. 1 is a perspective view showing a first embodiment of the invention in which the appliance attendance monitoring apparatus is originally manufactured with an electric range.

Turning to FIG. 1, there is shown a first embodiment of the appliance attendance monitoring apparatus of the invention generally designated by reference numeral 10. In FIG. 1, appliance attendance monitoring apparatus 10 is provided for an appliance 11, such as an electrical appliance, and includes a housing 12 and a motion sensor assembly 14 contained in the housing 12. A timer assembly 16 is electrically connected to the motion sensor assembly 14, and an audible alarm assembly 18 is electrically connected to the timer assembly 16. The timer assembly 16 is adjustable for selecting a range of predetermined time intervals. Optionally, a current controller 20 is electrically connected to the timer assembly 16. The current controller 20 controls electric power to the appliance 11.

As shown in FIG. 1, the housing 12 can be comprised of walls which also serve to house manual controls for the individual range units of the appliance 11 which is illustrated as an electric range. Such an embodiment of the invention can be manufactured into the appliance 11 during manufacture of the appliance 11.

Figure 2:
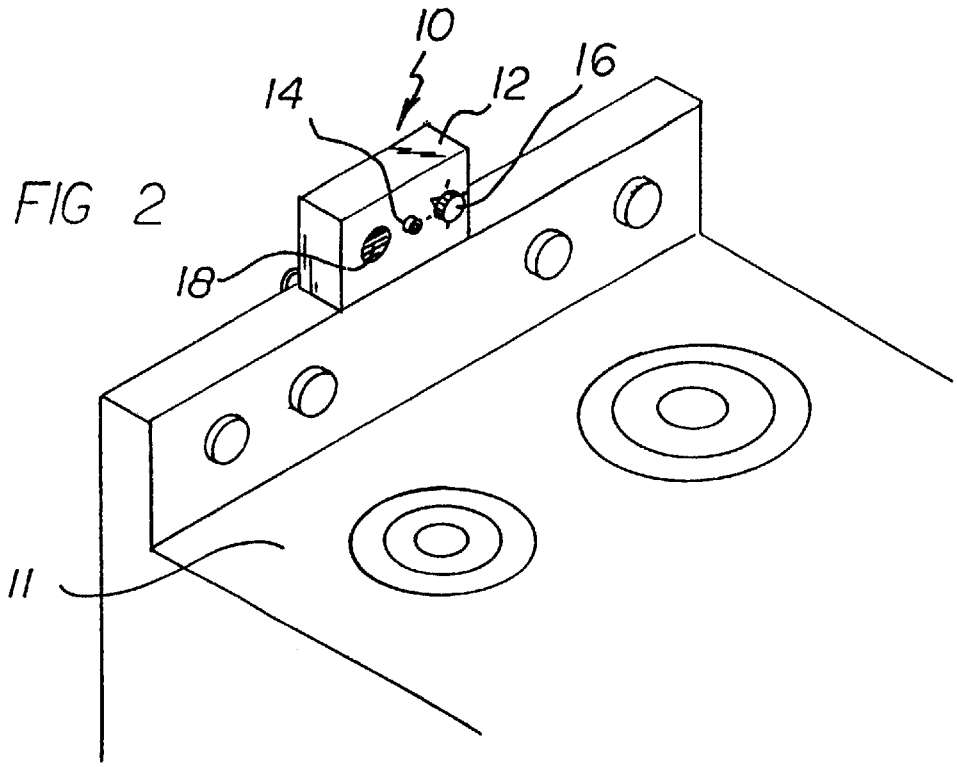
FIG. 2 is a perspective view showing a second embodiment of the invention in which the appliance attendance monitoring apparatus is manufactured as a unit which is retrofitted to an existing electric range.

Another embodiment of the invention in shown in FIG. 2 wherein a separate and distinct housing 12 is provided for the invention so that an appliance 11 can be retrofitted with the invention.

The operation of the invention is understood most easily with reference to FIGS. 3 and 4. In the sequence of events depicted in FIG. 4, a logical starting point is the status of the motion sensor assembly 14. If motion of a person attending or using the electric stove 11 is not detected, the timer assembly 16 stays off. With the timer off, the current controller 20 interrupts electrical power flow to the appliance 11, and the appliance 11 remains off. However, when motion is detected, the timer assembly 16 is started, and the current controller 20 is activated to permit current flow to the range units of the electric stove. As the timer runs, the motion sensor assembly 14 continues to be capable of sensing motion of a person attending or using the appliance 11. Each time a motion is sensed, the timer is reset. However, if the timer runs its predetermined time interval, and motion has not been detected to reset the timer, the timer assembly 16 activates the audible alarm assembly 18. Moreover, when motion has not been detected for the predetermined time interval, the timer assembly 16 activates the current controller 20 to interrupt electrical current flow to the appliance 11, and the appliance 11 is shut off.

The components of the appliance attendance monitoring apparatus of the invention can be made from inexpensive and durable metal, plastic, and electrical components. The various assemblies and or sub-assemblies making up the present invention can be fabricated from well known electrical or electronic components such as microprocessors, switches, relays, and the like as will obviously occur to those with only ordinary skill in this art.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved appliance attendance monitoring apparatus that is low in cost, relatively simple in design and operation, and which may advantageously be used to employ an audible signal to alert a person that an appliance has been unattended to prevent the occurrence of a hazardous condition. With the invention, an appliance attendance monitoring apparatus is provided which signals a person to be attentive to an appliance without modifying the wiring or fuel source of the appliance. With the invention, an appliance attendance monitoring apparatus is provided which signals a person audibly when a predetermined period of time has expired with an appliance not being attended to by a person. With the invention, an appliance attendance monitoring apparatus is provided which both provides an audible signal to a person and shuts off electric power to the appliance after a predetermined period of time has elapsed without a person being in attendance of the appliance. With the invention, an appliance attendance monitoring apparatus is provided which can easily be retrofitted to electric ranges that do not currently provide alarms to signal a person that the electric range has not been attended to for a predetermined period of time.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed is:

1. An attendance monitoring apparatus for an appliance, comprising:

a housing, a motion sensor assembly contained in said housing, a timer assembly electrically connected to said motion sensor assembly, an alarm assembly electrically connected to said timer assembly, and further including means responsive to the output of the motion sensor to reset said timer assembly and disenable said alarm assembly for a predetermined time period determined by said timer assembly;

wherein said timer assembly is adjustable;

wherein said means responsive to the output of said motion sensor comprises a current controller connected to said timer assembly and said motion sensor for electrically controlling electric power to the appliance in response to said motion sensor; and wherein said current controller is adapted to activate said alarm assembly simultaneously upon disconnecting electrical power to said appliance in response to the motion sensor detecting no motion during the reset time period determined by said adjustable timer assembly.

* * * * *